US005084190A

United States Patent [19]

Fernandez

[11] Patent Number: 5,084,190

[45] Date of Patent: Jan. 28, 1992

[54] FIRE EXTINGUISHING COMPOSITION AND PROCESS

[75] Inventor: Richard E. Fernandez, Bear, Del.

[73] Assignee: E. I. Du Pont de Nemours and Company, Wilmington, Del.

[21] Appl. No.: 436,464

[22] Filed: Nov. 14, 1989

[51] Int. Cl.[5] ..... A62D 1/08

[52] U.S. Cl. ..... 252/8; 252/2; 252/3

[58] Field of Search ..... 252/2, 3, 8

[56] References Cited

U.S. PATENT DOCUMENTS

| | | | |
|---|---|---|---|
| 3,080,430 | 3/1963 | Cohen | 260/653 |
| 3,656,553 | 4/1972 | Rainaldi et al. | 252/8 |
| 4,226,728 | 10/1980 | Kung | 252/8 |
| 4,459,213 | 7/1984 | Uchida et al. | 252/8.05 |
| 4,945,119 | 7/1990 | Smits et al. | 252/182.15 |

*Primary Examiner*—Robert L. Stoll
*Assistant Examiner*—Joseph D. Anthony

[57] ABSTRACT

A process for extinguishing, preventing and controlling fires using a composition containing at least one fluoro-substituted propane selected from the group of $CF_3—CHF—CF_3$, $CF_3—CF_2—CHF_2$, $CF_3—CFH—CF_2H$, $CF_3—CH_2—CF_3$, $CF_3—CF_2—CH_2F$, $CHF_2—CF_2—CHF_2$, $CF_3—CF_2—CHCl_2$, $CHFCl—CF_2—CClF_2$, $CHF_2—CCl_2—CF_3$, $CF_3—CHCl—CClF_2$, $CHF_2—CF_2—CHClF$, $CF_3—CR_2—CH_2Cl$, $CClF_2—CF_2—CH_2F$, $CF_3—CH_2—CClF_2$, $CHClF—CR_2—CF_3$, $CHF_2—CF_2—CF_2Cl$, $CF_3—CHCl—CF_3$, $CF_3—CHF—CF_2Cl$, and $CHF_2—CFCl—CF_3$ is disclosed. The fluoropropanes can be used in open or enclosed areas with little or no effect on the ozone in the stratosphere and with little effect on the global warming process.

7 Claims, No Drawings

FIRE EXTINGUISHING COMPOSITION AND PROCESS

FIELD OF INVENTION

This invention relates to compositions for use in preventing and extinguishing fires based on the combustion of combustible materials. More particularly, it relates to such compositions that are highly effective and "environmentally safe". Specifically, the compositions of this invention have little or no effect on the ozone layer depletion process; and make no or very little contribution to the global warming process known as the "greenhouse effect". Although these compositions have minimal effect in these areas, they are extremely effective in preventing and extinguishing fires, particularly fires in enclosed spaces.

BACKGROUND OF THE INVENTION AND PRIOR ART

In preventing or extinguishing fires, two important elements must be considered for success: (1) separating the combustibles from air; and (2) avoiding or reducing the temperature necessary for combustion to proceed. Thus, one can smother small fires with blankets or with foams to cover the burning surfaces to isolate the combustibles from the oxygen in the air. In the customary process of pouring water on the burning surfaces to put out the fire, the main element is reducing temperature to a point where combustion cannot proceed. Obviously, some smothering or separation of combustibles from air also occurs in the water situation.

The particular process used to extinguish fires depends upon several items, e.g. the location of the fire, the combustibles involved, the size of the fire, etc. In fixed enclosures such as computer rooms, storage vaults, rare book library rooms, petroleum pipeline pumping stations and the like, halogenated hydrocarbon fire extinguishing agents are currently preferred. These halogenated hydrocarbon fire extinguishing agents are not only effective for such fires, but also cause little, if any, damage to the room or its contents. This contrasts to the well-known "water damage" that can sometimes exceed the fire damage when the customary water pouring process is used.

The halogenated hydrocarbon fire extinguishing agents that are currently most popular are the bromine-containing halocarbons, e.g. bromofluoromethane ($CF_3Br$, Halon 1301) and bromochlorodifluoromethane ($CF_2ClBr$, Halon 1211). It is believed that these bromine-containing fire extinguishing agents are highly effective in extinguishing fires in progress because, at the elevated temperatures involved in the combustion, these compounds decompose to form products containing bromine atoms which effectively interfere with the self-sustaining free radical combustion process and, thereby, extinguish the fire. These bromine-containing halocarbons may be dispensed from portable equipment or from an automatic room flooding system activated by a fire detector.

In many situations, enclosed spaces are involved. Thus, fires may occur in rooms, vaults, enclosed machines, ovens, containers, storage tanks, bins and like areas. The use of an effective amount of fire extinguishing agent in an enclosed space involves two situations. In one situation, the fire extinguishing agent is introduced into the enclosed space to extinguish an existing fire; the second situation is to provide an ever-present atmosphere containing the fire "extinguishing" or, more accurately the fire prevention agent in such an amount that fire cannot be initiated nor sustained. Thus, in U.S. Pat. No. 3,844,354, Larsen suggests the use of chloropentafluoroethane ($CF_3$—$CF_2Cl$) in a total flooding system (TFS) to extinguish fires in a fixed enclosure, the chloropentafluoroethane being introduced into the fixed enclosure to maintain its concentration at less than 15%. On the other hand, in U.S. Pat. No. 3,715,438, Huggett discloses creating an atmosphere in a fixed enclosure which does not sustain combustion. Huggett provides an atmosphere consisting essentially of air, a perfluorocarbon selected from carbon tetrafluoride, hexafluoroethane, octafluoropropane and mixtures thereof.

It has also been known that bromine-containing halocarbons such as Halon 1211 can be used to provide an atmosphere that will not support combustion. However, the high cost due to bromine content and the toxicity to humans i.e. cardiac sensitization at relatively low levels (e.g. Halon 1211 cannot be used above 1-2%) make the bromine-containing materials unattractive for long term use.

In recent years, even more serious objections to the use of brominated halocarbon fire extinguishants has arisen. The depletion of the stratospheric ozone layer, and particularly the role of chlorofluorocarbons (CFC's) have led to great interest in developing alternative refrigerants, solvents, blowing agents, etc. It is now believed that bromine-containing halocarbons such as Halon 1301 and Halon 1211 are at least as active as chlorofluorocarbons in the ozone layer depletion process.

While perfluorocarbons such as those suggested by Huggett, cited above, are believed not to have as much effect upon the ozone depletion process as chlorofluorocarbons, their extraordinarily high stability makes them suspect in another environmental area, that of "greenhouse effect". This effect is caused by accumulation of gases that provide a shield against heat transfer and results in the undesirable warming of the earth's surface.

There is, therefore, a need for an effective fire extinguishing composition and process which contributes little or nothing to the stratospheric ozone depletion process or to the "greenhouse effect"

It is an object of the present invention to provide such a fire extinguishing composition; and to provide a process for preventing and controlling fire in a fixed enclosure by introducing into said fixed enclosure, an effective amount of the composition.

SUMMARY OF INVENTION

The present invention is based on the finding that an effective amount of a composition consisting essentially of at least one partially fluoro-substituted propane selected from the group of the heptafluoropropanes ($CF_3$—$CF_2$—$CHF_2$ and $CF_3$—CFH—$CF_3$), also known as HFC-227ca and HFC-227ea, the hexafluoropropanes ($CF_3$—$CH_2$—$CF_3$—$CF_3$—$CH_2$ $CH_2F$ and $CF_2H$—$CF_2$—$CF_2H$), also known as HFC-236fa, HFC-236 cb and HFC-236 ca, and the chlorohexafluoropropanes (CFClF-$CF_2$—CF3, CHF $CF_3$—CHCl-$CF_3$, $CF_3$—CHF—$CF_2Cl$, and $CHF_2$-CFCl-$CF_3$), also known as HCFC-226ca, HCFC-226cb, HCFC-226da, HCFC-226ea and HCFC-226ba, will prevent and/or extinguish fire based on the combustion of combustible materials, particularly in an enclosed space, without adversely affecting the atmosphere from the standpoint of ozone depletion or "greenhouse effect". Also useful in this invention are those partially fluoro-substituted propanes with normal boiling points above 25° C., i.e. HFC-236ea, HCFC-225ca, HCFC-225cb, HCFC-225aa, HCFC-225da, HCFC-235ca, HCFC-235cb, HCFC-235cc, and HCFC-235fa.

The partially fluoro-substituted propanes above may be used in conjunction with as little as 1% of at least one halogenated hydrocarbon selected from the group of difluoromethane (HFC-32), chlorodifluoromethane (HCFC-22), 2,2-dichloro-1,1,1-trifluoroethane (HCFC-123), 1,2-dichloro-1,1,2-trifluoroethan (HCFC-123a), 2-chloro-1,1,1,2-tetrafluoroethane (HCFC-124), 1-chloro-1,1,2,2-tetrafluoroethane (HCFC-124a), pentafluoroethane (HFC-125), 1,1,2,2-tetrafluoroethane (HFC-134), 1,1,1,2-tetrafluoroethane (HFC-134a), 3,3-dichloro-1,1,1,2,2-pentafluoropropane (HCFC-225ca), 1,3-dichloro-1,1,2,2,3-pentafluoropropane (HCFC-225cb), 2,2-dichloro-1,1,1,3,3-pentafluoropropane (HCFC-225aa), 2,3-dichloro-1,1,1,3,3-pentafluoropropane (HCFC-225da), 1,1,1,2,2,3,3-heptafluoropropane (HFC-227ca), 1,1,1,2,3,3,3-heptafluoropropane (HFC-227ea), 1,1,1,2,3,3-hexafluoropropane (HFC-236ea), 1,1,1,3,3,3-hexafluoropropane (HFC-236fa), 1,1,1,2,2,3-hexafluoropropane (HFC-236cb), 1,1,2,2,3,3-hexafluoropropane (HFC-236ca), 3-chloro-1,1,2,2,3-pentafluoropropane (HCFC-235ca), 3-chloro-1,1,1,2,2-pentafluoropropane (HCFC-235cb), 1-chloro-1,1,2,2,3-pentafluoropropane (HCFC-235cc), 3-chloro-1,1,1,3,3-pentafluoropropane (HCFC-235fa), 3-chloro-1,1,1,2,2,3-hexafluoropropane (HCFC-226ca), 1-chloro-1,1,2,2,3,3-hexafluoropropane (HCFC-226cb), 2-chloro-1,1,1,3,3,3-hexafluoropropane (HCFC-226da), 3-chloro-1,1,1,2,3,3-hexafluoropropane (HCFC-226ea), and 2-chloro-1,1,1,2,3,3-hexafluoropropane (HCFC-226ba).

PREFERRED EMBODIMENTS

The partially fluoro-substituted propanes, when added in adequate amounts to the air in a confined space, eliminate the combustion-sustaining properties of the air and suppress the combustion of flammable materials, such as paper, cloth, wood, flammable liquids, and plastic items, which may be present in the enclosed compartment.

These fluoropropanes are extremely stable and chemically inert. They do not decompose at temperatures as high as 350° C. to produce corrosive or toxic products and cannot be ignited even in pure oxygen so that they continue to be effective as a flame suppressant at the ignition temperatures of the combustible items present in the compartment.

The preferred fluoropropanes are HFC-227 ca, HFC-227 ea, HFC-236 cb, HFC-236 fa, HFC-236 ca and HFC-236 ca, i.e. the HFC-227 and 236 series. The particularly preferred fluoropropanes HFC-227 ca, HFC-227 ea, HFC-236 cb and HFC-236 fa are additionally advantageous because of their low boiling points, i.e. boiling points at normal atmospheric pressure of less than 1.2° C. Thus, at any low environmental temperature likely to be encountered, these gases will not liquefy and will not, thereby, diminish the fire preventive properties of the modified air. In fact, any material having such a low boiling point would be suitable as a refrigerant.

The heptafluoropropanes HFC-227 ea and HFC-227 ca are also characterized by an extremely low boiling point and high vapor pressure, i.e. above 44.3 and 42.0 psig at 21° C. respectively. This permits HFC-227 ea and HFC-227 ca to act as their own propellants in "hand-held" fire extinguishers. Heptafluoropropanes (HFC-227 ea and HFC-227 ca) may also be used with other materials such as those disclosed on page 5 of this specification to act as the propellant and coextinguishant for these materials of lower vapor pressure. Alternatively, these other materials of lower vapor pressure may be propelled from a portable fire extinguisher or fixed system by the usual propellants, i.e. nitrogen or carbon dioxide. Their relatively low toxicity and their short atmospheric lifetime (with little effect on the global warming potential) compared to the perfluoroalkanes (with lifetimes of over 500 years) make these fluoropropanes ideal for this fire-extinguisher use.

To eliminate the combustion-sustaining properties of the air in the confined space situation, the gas or gases should be added in an amount which will impart to the modified air a heat capacity per mole of total oxygen present sufficient to suppress or prevent combustion of the flammable, non-self-sustaining materials present in the enclosed environment.

The minimum heat capacity required to suppress combustion varies with the combustibility of the particular flammable materials present in the confined space. It is well known that the combustibility of materials, namely their capability for igniting and maintaining sustained combustion under a given set of environmental conditions, varies according to chemical composition and certain physical properties, such as surface area relative to volume, heat capacity, porosity, and the like. Thus, thin, porous paper such as tissue paper is considerably more combustible than a block of wood.

In general, a heat capacity of about 40 cal./°C and constant pressure per mole of oxygen is more than adequate to prevent or suppress the combustion of materials of relatively moderate combustibility, such as wood and plastics. More combustible materials, such as paper, cloth, and some volatile flammable liquids, generally require that the fluoropropane be added in an amount sufficient to impart a higher heat capacity. It is also desirable to provide an extra margin of safety by imparting a heat capacity in excess of minimum requirements for the particular flammable materials. A minimum heat capacity of 45 cal./ C per mole of oxygen is generally adequate for moderately combustible materials and a minimum of about 50 cal./.C per mole of oxygen for highly flammable materials. More can be added if desired but, in general, an amount imparting a heat capacity higher than about 55 cal./° C. per mole of total oxygen adds substantially to the cost without any substantial further increase in the fire safety factor.

Heat capacity per mole of total oxygen can be determined by the formula:

$$C_p^* = (C_p)_{o2} + \frac{P_z}{P_{o2}} (C_p)_z$$

wherein:

$C_p^*$ = total heat capacity per mole of oxygen at constant pressure;

$P_{o2}$ = partial pressure of oxygen;

$P_z$ = partial pressure of other gas;

$(C_p)z$ = heat capacity of other gas at constant pressure.

The boiling points of the fluoropropanes used in this invention and the mole percents required to impart to air heat capacities (Cp) of 40 and 50 cal./°C. at a temperature of 25° C. and constant pressure while maintaining a 20% and 16% oxygen content are tabulated below:

| FC | Boiling point, °C. | 20% $O_2$ Cp = 40 vol percent | 20% $O_2$ Cp = 50 vol percent | 16% $O_2$ Cp = 50 vol percent |
|---|---|---|---|---|
| 236ea | 26.2 | 4.5 | 13.5 | 4.5 |
| 236fa | −0.7 | 4.5 | 13.0 | 4.5 |
| 236cb | 1.2 | 4.5 | 13.0 | 4.5 |
| 236ca | 10.0 | 4.5 | 13.5 | 4.5 |
| 227ea | −18.0 | 4.0 | 12.0 | 4.0 |
| 227ca | −17.0 | 4.0 | 12.0 | 4.0 |
| 225ca | 53.0 | 3.8 | 11.0 | 3.8 |
| 225cb | 52.0 | 3.8 | 11.0 | 3.8 |
| 225aa | 55.4 | 3.8 | 11.0 | 3.8 |
| 225da | 50.4 | 3.5 | 10.8 | 3.5 |
| 235ca | 44.8 | 4.5 | 13.0 | 4.5 |
| 235cb | 27.2 | 4.3 | 12.5 | 4.3 |
| 235cc | 36.1 | 4.3 | 12.5 | 4.3 |
| 235fa | 28.4 | 4.0 | 12.5 | 4.0 |
| 226ca | 20.0 | 4.0 | 11.5 | 4.0 |
| 226cb | 21.5 | 4.0 | 11.5 | 4.0 |
| 226da | 14.5 | 4.0 | 11.0 | 4.0 |
| 226ea | 16.0 | 4.0 | 11.5 | 4.0 |
| 226ba | 16.4 | 4.0 | 11.5 | 4.0 |

Introduction of the appropriate fluoropropanes is easily accomplished by metering appropriate quantities of the gas or gases into the enclosed air-containing compartment.

The air in the compartment can be treated at any time that it appears desirable. The modified air can be used continuously if a threat of fire is constantly present or if the particular environment is such that the fire hazard must be kept at an absolute minimum; or the modified air can be used as an emergency measure if a threat of fire develops.

The invention will be more clearly understood by referring to the examples which follow. The unexpected effects of the fluoropropanes, alone and in any of the aforementioned blends, in suppressing and combating fire, as well as its compatibility with the ozone layer and its relatively low "greenhouse effect", when compared to other fire-combating gases, particularly the perfluoroalkanes and Halon 1211, are shown in the examples.

EXAMPLE 1

Fire Extinguishing Concentrations

The fire extinguishing concentration of the fluoropropane compositions compared to several controls, was determined by the ICI Cup Burner method. This method is described in "Measurement of Flame-Extinguishing Concentrations" R. Hirst and K. Booth, Fire Technology, vol. 13(4): 296–315 (1977).

Specifically, an air stream is passed at 40 liters/minute through an outer chimney (8.5 cm. I. D. by 53 cm. tall) from a glass bead distributor at its base. A fuel cup burner (3.1 cm. 0° D. and 2.15 cm. I.D.) is positioned within the chimney at 30.5 cm. below the top edge of the chimney. The fire extinguishing agent is added to the air stream prior to its entry into the glass bead distributor while the air flow rate is maintained at 40 liters/minute for all tests. The air and agent flow rates are measured using calibrated rotameters.

Each test is conducted by adjusting the fuel level in the reservoir to bring the liquid fuel level in the cup burner just even with the ground glass lip on the burner cup. With the air flow rate maintained at 40 liters/minute, the fuel in the cup burner is ignited. The fire extinguishing agent is added in measured increments until the flame is extinguished. the fire extinguishing concentration is determined from the following equation:

$$\text{Extinguishing concentration} = \frac{F_1}{F_1 + F_2} \times 100$$

where $F_1$ = Agent flow rate $F_2$ = Air flow rate

Two different fuels are used, heptane and methanol; and the average of several values of agent flow rate at extinguishment is used for the following table.

TABLE 1

Extinguishing Concentrations of Certain Fluoropropane Compositions Compared to Other Agents

| Agent Fe # | Fuel: Heptane Extinguishing Conc. (vol. %) | Fuel: Methanol Extinguishing Conc. (vol. %) | Flow Rate: Air (l/min) | Flow Rate: Agent (l/min) Hept. | Flow Rate: Agent (l/min) Meth. |
|---|---|---|---|---|---|
| HFC-227ea | 7.3 | 10.1 | 40.1 | 3.14 | 4.52 |
| HFC-236ea | 10.2 | 8.4 | 40.1 | 4.55 | 3.68 |
| HCFC-235cb | 6.2 | 8.2 | 40.1 | 2.60 | 3.57 |
| $CF_4$ | 20.5 | 23.5 | 40.1 | 10.31 | 12.34 |
| $C_2F_6$ | 8.7 | 11.5 | 40.1 | 3.81 | 5.22 |
| H-1301* | 4.2 | 8.6 | 40.1 | 1.77 | 3.77 |
| H-1211** | 6.2 | 8.5 | 40.1 | 2.64 | 3.72 |
| $CHF_2Cl$ | 13.6 | 22.5 | 40.1 | 6.31 | 11.64 |

*$CF_3Br$
**$CF_2ClBr$

EXAMPLE 2

The ozone depletion potential (ODP) of the fluoropropanes and various blends thereof, compared to various controls, was calculated using the method described in "The Relative Efficiency of a Number of Halocarbon for Destroying Stratospheric Ozone" D. J. Wuebles, Lawrence Livermore Laboratory report UCID-18924, (January 1981) and "Chlorocarbon Emission Scenarios: Potential Impact on Stratospheric Ozone" D. J. Wuebles, Journal Geophysics Research, 88, 1433–1443 (1983).

Basically, the ODP is the ratio of the calculated ozone depletion in the stratosphere resulting from the emission of a particular agent compared to the ODP resulting from the same rate of emission of FC-11 ($CFCl_3$) which is set at 1.0. Ozone depletion is believed to be due to the migration of compounds containing chlorine or bromine through the troposphere into the stratosphere where these compounds are photolyzed by UV radiation into chlorine or bromine atoms. These atoms will destroy the ozone ($O_3$) molecules in a cyclical reaction where molecular oxygen ($O_2$) and [ClO]or [BrO]radicals are formed, those radicals reacting with oxygen atoms formed by UV radiation of $O_2$ to reform chlorine or bromine atoms and oxygen molecules, and the reformed chlorine or bromine atoms then destroying additional ozone, etc., until the radicals are finally scavenged from the stratosphere. It is estimated that one chlorine atom will destroy 10,000 ozone molecules and one bromine atom will destroy 100,000 ozone molecules.

The ozone depletion potential is also discussed in "Ultraviolet Absorption Cross-Sections of Several Brominated Methanes and Ethanes" L. T. Molina, M. J. Molina and F. S. Rowland J. Phys. Chem. 86, 2672-2676 (1982); in bivens et al. U.S. Pat. No. 4,810,403; and in "Scientific Assessment of Stratospheric Ozone: 1989" U.N. Environment Programme (21 August 1989).

In the following table, the ozone depletion potentials are presented for the fluoropropanes and the controls.

TABLE 2

| Agent | Ozone Depletion Potential |
|---|---|
| HFC-236ea | 0 |
| HFC-236fa | |
| HFC-236cb | 0 |
| HFC-236ca | 0 |
| HFC-227ea | 0 |
| HFC-227ca | 0 |
| $CF_4$ | 0 |
| $C_2F_6$ | 0 |
| H-1301 | 10 |
| $CHF_2Cl$ | 0.05 |
| H-1211 | 3 |
| $CFCl_3$ | 1 |
| $CF_3—CF_2Cl$ | 0.4 |

I claim:

1. A fire extinguishing composition consisting essentially of at least 4 volume percent of at least one fluoro-substituted propane selected from the group of $CH_3—CHF—CF_3$, $CHF_2—CH_2—CF_3—CH_2—CF_3$, $CF_3—CF_2—CH_2f$ $CF_2H—CF_2—CHF_2$, $CHClF—CF_2—CF_3$, $CHF_2—CF_2Cl$, $CF_3—CHCl—CF_3$, $CF_3—CHF—CF_2Cl$, and $CHF_2—Cl$, and $CHF_2—CFCl—CF_3$.

2. The composition of claim 1 wherein at least 1% of at least one halogenated hydrocarbon is blended with said fluoro-substituted propane said halogenated hydrocarbon being selected from the group consisting of difluoromethane, chlorodifluoromethane, 2,2-dichloro-1,1,1-trifluoroethane, 1,2-dichloro-1,1,2-trifluoroethane, 2-chloro-1,1,1,2-tetrafluoroethane, 1-chloro-1,1,2,2-tetrafluoroethane, pentafluoroethane, 1,1,2,2-tetrafluoroethane, 1,1,1,2-tetrafluoroethane, 1,2-dichloro-1,2-difluoroethane, 1,1-dichloro-1,2-difluoroethane, 3,3-dichloro-1,1,1,2,2-pentafluoropropane, 1,3-dichloro-1,1,2,2,3-pentafluoropropane, 2,2-dichloro-1,1,1,3,3-pentafluoropropane, 2,3-dichloro-1,1,1,3,3-pentafluoropropane, 1,1,1,2,2,3,3-heptafluoropropane, 1,1,1,2,3,3,3-heptafluoropropane, 1,1,1,2,3,3-hexafluoropropane, 1,1,1,3,3,3-hexafluoropropane, 1,1,1,2,2,3-hexafluoropropane, 1,1,2,2,3,3-hexafluoropropane, 3-chloro-1,1,2,2,3-pentafluoropropane, 3-chloro-1,1,1,2,2-pentafluoropropane, 1-chloro-1,1,2,2,3-pentafluoropropane, 3-chloro-1,1,1,3,3-pentafluoropropane, 3-chloro-1,1,1,2,2,3-hexafluoropropane, 1-chloro-1,1,2,2,3,3-hexafluoropropane, 2-chloro-1,1,1,3,3,3-hexafluoropropane, 3-chloro-1,1,1,2,3,3-hexafluoropropane, and 2-chloro-1,1,1,2,3,3-hexafluoropropane.

3. A fire extinguishing composition consisting essentially of at least one fluoro-substituted propane selected from the group of $CF_3—CFH—CF_3$, $CF_3—CF_2—CHF_2$, $CH_3—CHF—CF_2H$, $CF_3—CH_2—CF_3$, $CF_3—CF$ $CF_2H—CF_2—CHF_2$, $CF_3—CF_2—CHC_{12}$, $CHFCl—CF_2—CF_2Cl$, $CHF_2—CCl_2—CF_3$, $CF_3—CHCl—CClF_2$, $CHF_2—CHClF$, $CF_3—CF_2—CH_2Cl$, $CClF_2—CF_2—CH_2F$, $CF_3—CH_2$, $—CClF_2$, $CHClF—CF_2—CF_3$, $CHF_2—CF_2—CF_2Cl$, $CF_3—CHCl—CF_3$, $CF_3—CHF—CF_2Cl$, and $CHF_2—CFCl—CF_3$.

4. The composition of claim 3 wherein nitrogen or any other propellant usually used in portable fire extinguishers is added in sufficient quantity to provide a pressure of at least 140 psig in said portable fire extinguisher.

5. The composition of claim 3 wherein at least 1% of at least one halogenated hydrocarbon is blended with said fluoro-substituted propane, said halogenated hydrocarbon being selected from the group consisting of difluoromethane, chlorodifluoromethane, 2,2-dichloro-1,1,1-trifluoroethane, 1,2-dichloro-1,1,2-trifluoroethane, 2-chloro-1,1,1,2-tetrafluoroethane, 1-chloro-1,1,2,2-tetrafluoroethane, pentafluoroethane, 1,1,2,2-tetrafluoroethane, 1,1,1,2-tetrafluoroethane, 1,2-dichloro-1,2-difluoroethane, 1,1-dichloro-1,2-difluoroethane, 3,3-dichloro-1,1,1,2,2-pentafluoropropane, 1,3-dichloro-1,1,2,2,3-pentafluoropropane, 2,2-dichloro-1,1,1,3,3-pentafluoropropane, 2,3-dichloro-1,1,1,3,3-pentafluoropropane, 1,1,1,2,2,3,3-heptafluoropropane, 1,1,1,2,3,3,3-heptafluoropropane, 1,1,1,2,3,3-hexafluoropropane, 1,1,1,3,3,3-hexafluoropropane, 1,1,1,2,2,3-hexafluoropropane, 1,1,2,2,3,3-hexafluoropropane, 3-chloro-1,1,2,2,3-pentafluoropropane, 3-chloro-1,1,1,2,2-pentafluoropropane, 1-chloro-1,1,2,2,3-pentafluoropropane, 3-chloro-1,1,1,3,3-pentafluoropropane, 3-chloro-1,1,1,2,2,3-hexafluoropropane, 1-chloro-1,1,2,2,3,3-hexafluoropropane, 2-chloro-1,1,1,3,3,3-hexafluoropropane, 3-chloro-1,1,1,2,3,3-hexafluoropropane, and 2-chloro-1,1,1,2,3,3-hexafluoropropane.

6. The composition of claim 5 wherein nitrogen or any other propellant usually used in portable fire extinguishers is added in sufficient quantity to provide a pressure of at least 140 psig at 21° C. in said portable fire extinguisher.

7. A fire extinguishing composition comprising at least one fluoro-substituted propane selected from the group of $CF_3—CFH-CF_3$, $CF_3—CF_2—CHF_2$, $CF_3—CHF—CF_2H$, $CF_3—CF_3$, $CF_3—CF_2—CF_2F$ and $CF_2H—CF_2—CHF_2$.

* * * * *

UNITED STATES PATENT AND TRADEMARK OFFICE

CERTIFICATE OF CORRECTION

PATENT NO. : 5,084,190

DATED : Jan. 28, 1992

INVENTOR(S) : RICHARD EDWARD FERNANDEZ

It is certified that error appears in the above-indentified patent and that said Letters Patent is hereby corrected as shown below:

*ABSTRACT*

Line 9 in the Abstract of the printed patent: "$CF_3$-$CR_2$-$CH_2Cl$" should read "$CF_3$-$CF_2$-$CH_2Cl$"

Lines 9 and 10 in the Abstract of the printed patent: "$CF_3$-CH-$_2$-$CClF_2$, CHClF-$CR_2$-$CF_3$" should read "$CF_3$-$CH_2$-$CClF_2$, CHClF-$CF_2$-$CF_3$"

Column 1, line 48 in the printed patent: "bromofluoromethane" should read "bromotrifluoromethane"

Column 2, line 5 in the printed patent: "$CF_3$-$CF_2C1$" should read "$CF_3$-$CF_2Cl$"
(1 (number) changed to l (letter))

Column 2, lines 61 and 62 in the printed patent: "$CF_3$-$CH_2$-$CF_3$-$CF_3$-$CH_2CH_2F$ and $CF_2H$-CF-$_2$-$CF_2H$" should read "$CF_3$-$CH_2$-$CF_3$, $CF_3$-$CF_2$-$CH_2F$ and $CF_2H$-$CF_2$-$CF_2H$"

Column 2, line 64 in the printed patent: "CHF" should read "$CHF_2$-$CF_2$-$CF_2Cl$"

Column 3, line 14 in the printed patent: "1,2-dichloro-1,1,2-trifluoroethan" should read "1,2-dichloro-1,1,2-trifluoroethane"

*CLAIMS*

*CLAIM 1*

The formulas in Column 7 lines 33-37 (claim 1) in the printed patent contain multiple errors.

Column 7, lines 33-37 in the printed patent read: "$CH_3$-CHF-$CF_3$, $CHF_2$-$CH_2$-$CF_3$-$CH_2$-$CF_3$, $CF_3$-$CF_2$-$CH_2$f $CF_2H$-$CF_2$-$CHF_2$, CHClF-$CF_2$-$CF_3$, $CHF_2$-$CF_2Cl$, $CF_3$-CHCl-$CF_3$, $CF_3$-CHF-$CF_2Cl$, and $CHF_2$-Cl, and $CHF_2$-CFCl-$CF_3$."

Column 7, lines 33-37 in the printed patent should read: "$CF_3$-CHF-$CF_3$, $CHF_2$-$CF_2$-$CF_3$, $CF_3$-$CH_2$-$CF_3$, $CF_3$-$CF_2$-$CH_2F$, $CF_2H$-$CF_2$-$CHF_2$, CHClF-$CF_2$-$CF_3$, $CHF_2$-$CF_2$-$CF_2Cl$, $CF_3$-CHCl-$CF_3$, $CF_3$-CHF-$CF_2Cl$, and $CHF_2$-CFCl-$CF_3$"

UNITED STATES PATENT AND TRADEMARK OFFICE

CERTIFICATE OF CORRECTION

PATENT NO. : 5,084,190 Page 2 of 2

DATED : Jan. 28, 1992

INVENTOR(S) : RICHARD EDWARD FERNANDEZ

It is certified that error appears in the above-indentified patent and that said Letters Patent is hereby corrected as shown below:

*CLAIM 3*

Column 8, lines 7 and 8 in claim 3 of the printed patent: "$CF_3$-CF-$_2$-$CHF_2$" should read "$CF_3$-$CF_2$-$CF_2H$"

Column 8, line 9 in claim 3 of the printed patent: "$CF_3$-CF $CF_2H$-$CF_2$-$CHF_2$, $CF_3$-$CF_2$-$CHC_{l2}$" should read "$CF_3$-$CF_2$-$CH_2F$, $CF_2H$-$CF_2$-$CHF_2$, $CF_3$-$CF_2$-$CHCl_2$"

Column 8, line 11 in claim 3 of the printed patent: "$CHF_2$-CHClF" should read "$CHF_2$-$CF_2$-CHClF"

Column 8, line 12 in claim 3 of the printed patent: "$CF_3$-$CH_2$,-$CClF_2$" should read "$CF_3$-$CH_2$-$CClF_2$"

*CLAIM 7*

Column 8, line 55 in claim 7 of the printed patent: "$CF_3$-$CF_3$, $CF_3$-$CF_2$-$CF_2F$" should read "$CF_3$-$CH_2$-$CF_3$, $CF_3$-$CF_2$-$CH_2F$"

Signed and Sealed this

Twenty-second Day of April, 1997

Bruce Lehman

*Attest:*

BRUCE LEHMAN

*Commissioner of Patents and Trademarks*

*Attesting Officer*

US005084190C1

(12) EX PARTE REEXAMINATION CERTIFICATE (6631st)

United States Patent

Fernandez

(10) Number: US 5,084,190 C1

(45) Certificate Issued: Jan. 27, 2009

(54) FIRE EXTINGUISHING COMPOSITION AND PROCESS

(75) Inventor: Richard E. Fernandez, Bear, DE (US)

(73) Assignee: E. I. du Pont de Nemours and Company, Wilmington, DE (US)

Reexamination Request:
No. 90/007,052, May 26, 2004

Reexamination Certificate for:

| | |
|---|---|
| Patent No.: | **5,084,190** |
| Issued: | **Jan. 28, 1992** |
| Appl. No.: | **07/436,464** |
| Filed: | **Nov. 14, 1989** |

Certificate of Correction issued Apr. 22, 1997.

(51) Int. Cl.
*A62D 1/00* (2006.01)
*A62D 1/08* (2006.01)

(52) U.S. Cl. ..... 252/8; 252/2; 252/3

(58) Field of Classification Search ..... None
See application file for complete search history.

(56) References Cited

U.S. PATENT DOCUMENTS

| | | | | | |
|---|---|---|---|---|---|
| 1,926,395 | A | * | 9/1933 | Midgley, Jr. | 169/45 |
| 1,926,396 | A | * | 9/1933 | Midgley, Jr. et al. | 169/46 |
| 2,021,981 | A | * | 11/1935 | Bichowsky | 252/7 |
| 2,413,696 | A | * | 1/1947 | Downing et al. | 570/134 |
| 2,490,764 | A | * | 12/1949 | Benning et al. | 570/134 |
| 2,494,064 | A | * | 1/1950 | Simons et al. | 570/176 |
| 2,748,177 | A | | 5/1956 | Miller et al. | |
| 2,749,374 | A | | 6/1956 | Ruh et al. | |
| 2,749,375 | A | | 6/1956 | Ruh et al. | |
| 3,080,430 | A | * | 3/1963 | Cohen | 260/653 |
| 3,097,133 | A | * | 7/1963 | Suckling et al. | 514/761 |
| 3,479,286 | A | * | 11/1969 | Gian et al. | 252/8 |
| 3,656,553 | A | * | 4/1972 | Rainaldi et al. | 169/47 |
| 3,715,438 | A | * | 2/1973 | Huggett | 514/771 |
| 3,822,207 | A | * | 7/1974 | Howard et al. | 252/8 |
| 3,840,667 | A | | 10/1974 | Huggett | 514/771 |
| 3,844,354 | A | * | 10/1974 | Larsen | 169/46 |
| 4,226,728 | A | * | 10/1980 | Kung | 252/8 |
| 4,233,177 | A | | 11/1980 | Wittenhorst | 516/8 |
| 4,234,432 | A | | 11/1980 | Tarpley, Jr. | 252/8 |
| 4,446,923 | A | * | 5/1984 | Martin | 169/45 |
| 4,459,213 | A | * | 7/1984 | Uchida et al. | 252/8.05 |
| 4,465,609 | A | * | 8/1984 | Denis et al. | 252/67 |
| 4,807,706 | A | | 2/1989 | Lambertsen et al. | 169/45 |
| 4,810,403 | A | | 3/1989 | Bivens et al. | 252/67 |
| 4,851,595 | A | * | 7/1989 | Gumprecht | 570/170 |
| 4,945,119 | A | * | 7/1990 | Smits et al. | 252/182.15 |
| 4,954,271 | A | | 9/1990 | Green | 252/82 |
| 5,030,372 | A | * | 7/1991 | Manogue et al. | 252/67 |
| 5,040,609 | A | * | 8/1991 | Dougherty et al. | 169/45 |
| 5,084,190 | A | * | 1/1992 | Fernandez | 252/8 |
| 5,115,868 | A | * | 5/1992 | Dougherty et al. | 169/45 |
| 5,124,053 | A | * | 6/1992 | Iikubo et al. | 252/8 |
| 5,141,654 | A | * | 8/1992 | Fernandez | 252/8 |
| 5,406,009 | A | * | 4/1995 | Manogue et al. | 570/151 |

FOREIGN PATENT DOCUMENTS

| | | | | |
|---|---|---|---|---|
| CA | 902590 | A | * | 8/1962 |
| CA | 2023333 | | | 2/1991 |
| EP | 0 383 443 | A2 | | 8/1990 |
| EP | 0 439579 | B1 | | 8/1991 |
| EP | 0 481618 | A1 | | 4/1992 |
| EP | 0 570367 | B1 | | 11/1993 |
| GB | 902590 | | * | 8/1962 |
| JP | 48-19093 | | | 3/1973 |
| JP | 52-25679 | | | 7/1977 |
| JP | 57-93070 | A | * | 6/1982 |
| JP | 58 078677 | | | 5/1983 |
| JP | 1-115999 | | | 5/1989 |
| JP | 4-96770 | | | 3/1992 |
| JP | 4-501228 | | | 3/1992 |
| JP | 5-500920 | | | 2/1993 |
| JP | 50-50864 | | | 3/1993 |
| WO | WO 91/02564 | | | 3/1991 |
| WO | WO 91/04766 | | | 4/1991 |
| WO | WO 91/12853 | | | 9/1991 |

OTHER PUBLICATIONS

"Fire Protection Handbook Fourteenth Edition" (National Fire Protection Association, Boston), Section 13 Chapter 4, pp. 13–20 to 13–26.*

"Findings of the Chlorofluorocarbon Chemical Substitutes International Committee" (US EPA, NTIS, Springfield, VA), Apr. 1988, "Appendix A, Summary Report" (May 4, 1987), pp. A–1 to A–5.*

Burns, et al. "Fluorine Compounds in Anaesthesia" Anaesthesia, 1982, vol. 37, pp. 278–284.*

McFarland, Mack, "Chlorofluorocarbons and Ozone" in Environ. Sci. Technol., vol. 23, No. 10, 1989, pp. 1203–1207.*

Patent Owner supplied translation of JP HEI 4–96770–A.*

Patent Owner supplied translation of JP SHO 52–25679.*

Patent Owner supplied translation of JP SHO 48–19093.*

Patent Owner supplied translation of JP SHO 50–50864.*

Patent Owner supplied translation of JP HEI 01–115999–A.*

Patent Owner supplied translation of Tominaga, T., "Global and Technical Countermeasures against Flon," The Nikkan Kogyo Shimbun Ltd., pp. 134–137, 156–163, 170–174 (1989).*

(Continued)

*Primary Examiner*—Gary L Kunz

(57) ABSTRACT

A process for extinguishing preventing and controlling fires using a composition containing at least one fluoro-substituted propane selected from the group of $CF_3$—CHF—$CF_3$, $CF_3$—$CF_2$—$CHF_2$, $CF_3$—CFH—$CF_2H$, $CF_3$—$CH_2$—$CF_3$, $CF_3$—$CF_2$—$CH_2F$, $CHF_2$—$CF_2$—$CHF_2$, $CF_3$—$CF_2$—$CHCl_2$, CHFCl—$CF_2$—$CClF_2$, $CHF_2$—$CCl_2$—$CF_3$, $CF_3$—CHCl—$CClF_2$, $CHF_2$—$CF_2$—CHClF, $CF_3$—$CR_2$—$CH_2Cl$, $CClF_2$—$CF_2$—$CH_2F$, $CF_3$—$CH_2$—$CClF_2$, CHClF—$CR_2$—$CF_3$, $CHF_2$—$CF_2$—$CF_2Cl$, $CF_3$—CHCl—$CF_3$, $CF_3$—CHF—$CF_2Cl$, and $CHF_2$—CFCl—$CF_3$ is disclosed. The fluoropropanes can be used in open or enclosed areas with little or no effect on the ozone in the stratosphere and with little effect on the global warming process.

OTHER PUBLICATIONS

Patent Owner supplied translation of JP Kokai 57–93070–A.*
Patent Owner supplied translation of Kauschka et al. "Calculation of Thermodynamic substance data and reaction balance with poly—and perhalogen hydrocarbons," Chemistry Journal, 16 vol. 10 (Oct. 1976).*
U.S. Appl. No. 07/396,841.*
PCR Research Chemicals Catalog, pp. 34, 37, 38, 57, 116, 139, 141, 154 (1994).
SynQuest Fluorochemicals Catalog, p. 129 (2003).
United Nations Environment Program, Montreal Protocol Assessment Technology Review, "Final Report of the Halons—Technical Options Committee", Aug. 11, 1989.
Hogue, Cheryl, "Substitutes For Halons: No One Chemical Suitable", International Environment Reporter (Nov. 21, 1990).
Press Release, DuPont Fluoroproducts Obtains Global Access to HFC 227ea Patents (May 20, 2002).
Burkland, Robert E., "When It Comes To Fire Protection—Speed Counts", Automotive Industry Agenda (Mar. 2002), http://www.el.greatlakes.com/wfpeb/common/pdf/When%20it%20Comes%20to%20Fire%20Protection%20–%20Speed%20Counts.pdf.
Nelson, Kimberly T., "Model Design Helps EPA Compute Sustainability Into Savings" Environmental Design & Construction (Jul. 11, 2003), http://www.el.greatlakes.com/wfpeb/common/pdf/EPA%20Green%20Building%207–2003.pdf.
Product Brochure, "FM–200© Waterless Fire Protection For Marine Applications," Great Lakes Chemical Corporation (2003), http://www.el.greatlakes.com/wfpeb/common/pdf/MarineBro.pdf.
"CFC Halon News" Navy CFC & Halon Clearinghouse, vol. 7, No. 1, Spring 1997, https://www.denix.osd.mil/denix/Public/News/Navy/CFC/1996/Spring/cfc–spring.html.
Tapscott, Halon Alternatives, New Mexico Eng'g Res. Inst. pp. 1–12, Alburquerque, NM (Feb. 1989), "Halon Alternatives".
Clayton, J. Soc. Cosmetic Chemists, 18, pp. 333–350 (1967), "Fluorocarbon Toxicity: Past, Present, Future".
Landolt—Borstein, Zahlenwerte and Funktionen aus Physik, Chemie, Astronome, Geophysik and Technik, 6th ed. (1961) pp. E–31 & E–32.
C.F. Reinhardt et al., Arch. Environ. Health, vol. 22 (Feb. 1971) pp. 265–279, "Cardiac Arrhythmias and . . . ."
R. Hirst & K. Booth, Fire Technology (1977), pp. 296–315, "Measurement of Flame—Extinguishing Concentrations".
Bower, Frank A., Ph.D., "Nomenclature and Chemistry of Fluorocarbon Compounds," *Aerosp. Med. Res. Lab. Wright–Patterson Air Force Base, U.S. Nat. Tech. Inform. Sev. AD Rep,* pp. 9–16 (1971).
Burgoyne, et al., "Extinguishing Burning Liquids by the Application of Non–Inflammable Gases and Liquids," *Fuels,* vol. XXVIII–7, pp. 150–158 (1949).
Coulston, et al., "Study of Toxicological Evaluation of Fire Suppressants and Extinguishers", *NASA Contract No. NAS 9–9964 Final Report, Institute of Comparative and Human Toxicology, Albany Medical College* (Mar. 1975).
Hou, Yu–Chun, "Physical and Thermodynamic Properties of Trifluoromethane," *University of Michigan* (1955).
Midgley, Jr. et al., "Organic Fluorides as Refrigerants," *Ind. Eng. Chem.,* vol. 22, No. 5, pp. 542–545 (1930).
Parmelee, H.M., "Water Solubility of Freon Refrigerants Part I. Compounds Boiling Below 32F," *Refrig. Eng.,* vol. 61, pp. 1341–1345 (1953).
Simons, et al., "The Preparation and Properties of Certain Trifluoromethyl Compounds," *J. Amer. Chem. Soc.,* vol. 62, pp. 3477–3480 (Dec. 1940).
Fire Extinguishing Agents, Purdue Univ. Lafayette Ind. USA (Jul. 1950).
Belles, Frank E., "Chemical Action of Halogenated Agents in Fire Extinguishing," *National Advisory Committee for Aeronautics, Technical Note 3565,* (Sep. 1955).
Hynes et al. "Shock–Tube Study of the Pyrolysis of the Halon Replacement Molecule $CF_3CHFCF_3$," *J. Phys Chem. A.,* vol. 103, pp. 54–61 (1999).
"Joint Assessment of Commodity Chemicals No. 24," Pentafluoroethane (HFC 125), [ECETOC], p. 14–20 (May 1994).
Kauschka et al., "Berechnung von thermodynamischen Stoffdaten und Reaktionsgleichgewichten bie Poly–und Perhalogenkohlenwasserstoffen," *Zeitschrift fur Chemie,* 16 Heft 10, pp. 377–385 (Oct. 1976).
Kubota, Kazuo, "Current State and Measures Related to Chlorofluorocarbon Regulations, Part 1," *Valqua Review,* vol. 33, No. 2, pp. 1–8 [(1989)], (English translation).
Larsen, Eric. R., "Halogenated Fire Extinguishants: Flame Suppresion by a Physical Mechanism?," *ACS Symp. Ser.,* pp. 376–402 (1975).
Malcom, J.E., "Halogenated Extinguishing Agents; Part II Research at the Corps. of Engineers' Laboratories," *NFPA Quarterly,* pp. 119–131 (Oct. 1951).
Moore, et al., "Halon Alternatives Extinguishment Testing," *Paper Presented at the International Conference on CFC & Halon Alternatives,* pp. 1–8 (Oct. 10–11, 1989).
Nelson, Thomas P., "Findings of the Chlorofluorocarbon Chemical Substitutes International Committee," *U.S. Environmental Protection Agency, Air and Energy Engineering Research Laboratory, EPA–600/9–88–009, PB88195664,* (Apr. 1988).
Smart, Bruce E., "Fluorinated Organic Molecules," *Molecular Structure and Energetics,* vol. 3, ch. 4, pp. 141–142 (1986).
Smart, Bruce E., "Fluorocarbons", *The Chemistry of Functional Groups,* Supplement D, pp. 603–626 (1983).
Tominaga, T. "Global and Technical Countermeasures against Flon", *The Nikkan Kogyo Shinbun, Ltd.,* pp. 134–137, 156–163, 170–174 (1989).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–7 are determined to be patentable as amended.

1. A fire extinguishing composition consisting essentially of at least 4 volume percent of at least one fluoro-substituted propane selected from the group of $CF_3$—CHF—$CF_3$[, $CHF_2$—$CF_2$—$CF_3$—] *and* $CF_3$—$CH_2$—$CF_3$[, $CF_3$—$CF_2$—$CH_2F$, $CF_2H$—$CF_2$—$CHF_2$, CHClF—$CF_2$—$CF_3$, $CHF_2$—$CF_2$—$CF_2Cl$, $CF_3$—CHCl—$CF_3$, $CF_3$—CHF—$CF_2Cl$, and $CHF_2$—CFCl—$CF_3$], *in combination with nitrogen, carbon dioxide or other propellant usually used in portable fire extinguishers or fixed fire extinguishing systems*.

2. The composition of claim 1 wherein at least 1% of at least one halogenated hydrocarbon is blended with said *at least one* fluoro-substituted propane, said *at least one* halogenated hydrocarbon being selected from the group consisting of difluoromethane, chlorodifluoromethane, 2,2-dichloro 1,1,1-trifluoroethane, 1,2-dichloro-1,1,2-triflouroethane, 2-chloro-1,1,1,2-tetrafluoroethane, 1-chloro-1,1,2,2-tetrafluoroethane, pentafluoroethane, 1,1,2,2-tetrafluoroethane, 1,1,1,2-tetrafluoroethane, 1,2-dichloro-1,2,difluoroethane, 1,1-dichloro-1,2-difluoroethane, 3,3-dichloro-1,1,1,2,2-pentafluoropropane, 1,3-dichloro-1,1,2,2,3-pentafluoropropane, 2,2-dichloro-1,1,1,3,3-pentafluoropropane, 2,3-dichloro-1,1,1,3,3-pentafluoropropane, [1,1,1,2,2,3,3,3-heptafluoropropane, 1,1,1,2,3,3,3-heptafluoropropane, 1,1,1,2,3,3-hexafluoropropane, 1,1,1,3,3,3-hexafluoropropane, 1,1,1,2,2,3-hexafluoropropane, 1,1,2,2,3,3-hexafluoropropane,] 3-chloro-1,1,2,2,3-pentafluoropropane, 3-chloro-1,1,1,2,2-pentafluoropropane, 1-chloro-1,1,2,2,3-pentafluoropropane, *and* 3-chloro-1,1,1,3,3-pentafluoropropane [,3-chloro-1,1,1,2,2,3-hexafluoropropane, 1-chloro-1,1,2,2,3,3-hexafluoropropane, 2-chloro-1,1,1,3,3,3-hexafluoropropane, 3-chloro-1,1,1,2,3,3-hexafluoropropane, and 2-chloro-1,1,1,2,3,3-hexafluoropropane].

3. A fire extinguishing composition consisting essentially of at least one fluoro-substituted propane selected from the group of $CF_3CFH$—$CF_3$[, $CF_3$—$CF_2$—$CF_2H$, $CH_3$—CHF—$CF_2H$,] *and* $CF_3$—$CH_2$—$CF_3$[, $CF_3$—$CF_2$—$CH_2F$, $CF_2H$—$CF_2$—$CHF_2$, $CF_3$—$CF_2$—$CHCl_2$, CHFCl—$CF_2$—$CF_2Cl$, $CHF_2$—$CCl_2$—$CF_3$, $CF_3$—CHCl—$CClF_2$, $CHF_2$—$CF_2$—CHClF, $CF_3$—$CF_2$—$CH_2Cl$, $CClF_2$—$CF_2$—$CH_2F$, $CF_3$—$CH_2$—$CClF_2$, CHClF—$CF_2$—$CF_3$, $CHF_2$—$CF_2$—$CF_2Cl$, $CF_3$—CHCl—$CF_3$, $CF_3$—CHF—$CF_2Cl$, and $CHF_2$—CFCl—$CF_3$], *in combination with nitrogen, carbon dioxide or other propellant usually used in portable fire extinguishers or fixed fire extinguishing systems*.

4. The composition of claim 3 wherein the nitrogen or any other propellant usually used in portable fire extinguishers is added in sufficient quantity to provide a pressure of at least 140 psig *at 21° C.* in said portable fire extinguisher.

5. The composition of claim 3 wherein at least 1% of at least one halogenated hydrocarbon is blended with said *at least one* flouro-substituted propane, said *at least one* halogenated hydrocarbon being selected from the group consisting of difluoromethane, chlorodifluoromethane, 2,2-dichloro-1,1,1-trifluoroethane, 1,2-dichloro-1,1,2-trifluoroethane, 2-chloro-1,1,1,2-tetrafluoroethane, 1-chloro-1,1,2,2-tetrafluoroethane, pentafluoroethane, 1,1,2,2-tetrafluoroethane, 1,1,1,2-tetrafluoroethane, 1,2-dichloro-1,2-difluoroethane, 1,1-dichloro-1,2-difluoroethane, 3,3-dichloro-1,1,1,2,2,-pentafluoropropane, 1,3-dichloro-1,1,2,2,3-pentafluoropropane, 2,2-dichloro-1,1,1,3,3-pentafluoropropane, 2,3-dichloro-1,1,1,3,3-pentafluoropropane, [1,1,1,2,2,3,3-heptafluoropropane, 1,1,1,2,3,3,3-heptafluoropropane, 1,1,1,2,3,3-hexafluoropropane, 1,1,1,3,3,3-hexafluoropropane, 1,1,1,2,2,3-hexafluoropropane, 1,1,2,2,3,3-hexafluoropropane,] 3-chloro-1,1,2,2,3-pentafluoropropane, 3-chloro-1,1,1,2,2-pentafluoropropane, 1-chloro-1,1,2,2,3-pentafluoropropane, *and* 3-chloro-1,1,1,3,3-pentafluoropropane[, 3-chloro-1,1,1,2,2,3-hexafluoropropane, 1-chloro-1,1,2,2,3,3- hexafluoropropane, 2-chloro1,1,1,3,3,3-hexafluoropropane, 3-chloro-1,1,1,2,3,3-hexafluoropropane, and 2-chloro-1,1,1,2,3,3-hexafluoropropane].

6. The composition of claim 5 wherein *the* nitrogen or any other propellant usually used in portable fire extinguishers is added in sufficient quantity to provide a pressure of at least 140 psig at 21° C. in said portable fire extinguisher.

7. A fire extinguishing composition comprising at least one fluoro-substituted propane selected from the group of $CF_3$—CFH—$CF_3$[, $CF_3$—$CF_2$—$CHF_2$, $CF_3$—CHF—$CF_2H$,] *and* $CF_3$—$CH_2$—$CF_3$[, $CF_3$—$CF_2$—$CHF_2F$ and $CF_2H$—$CF_2$—$CHF_2$], *in combination with nitrogen, carbon dioxide or other propellant usually used in portable fire extinguishers or fixed fire extinguishing systems*.

* * * * *